United States Patent [19]

Hutchens

[11] 3,958,330

[45] May 25, 1976

[54] KNIFE AND LOCKING SCABBARD

[75] Inventor: Douglas R. Hutchens, Tigard, Oreg.

[73] Assignee: Gerber Legendary Blades, Portland, Oreg.

[22] Filed: May 21, 1975

[21] Appl. No.: 579,318

[52] U.S. Cl. ..... 30/151; 224/2 D
[51] Int. Cl.[2] ..... B26B 29/02
[58] Field of Search ..... 30/143, 151; 224/2 D

[56] References Cited

UNITED STATES PATENTS

| | | | |
|---|---|---|---|
| 2,650,008 | 8/1953 | Morseth | 224/2 D |
| 2,687,833 | 8/1954 | Sutton | 224/2 D |
| 2,783,536 | 3/1957 | McQuery | 30/151 |
| 3,246,813 | 4/1966 | Miller | 224/2 D |
| 3,257,050 | 6/1966 | Smith | 224/2 D |
| 3,533,540 | 10/1970 | Carinci | 224/2 D |

*Primary Examiner*—Al Lawrence Smith
*Assistant Examiner*—J. C. Peters
*Attorney, Agent, or Firm*—Klarquist, Sparkman, Campbell, Leigh, Hall & Whinston

[57] ABSTRACT

A combination of a knife and scabbard is disclosed, the knife having a lateral projection on its handle and the scabbard having a stop on the inner surface of one side edge thereof for engaging the projection when the knife is inserted into the scabbard, preventing accidental release of the knife. A slot opening in the upper part of the scabbard opposite the stop can be widened by forcing the knife handle into it to disengage the projection from the stop, permitting the knife to be withdrawn from the scabbard. A strap and fastener releasably prevent widening of the slot opening to lock the knife in the scabbard.

11 Claims, 6 Drawing Figures

FIG. 1
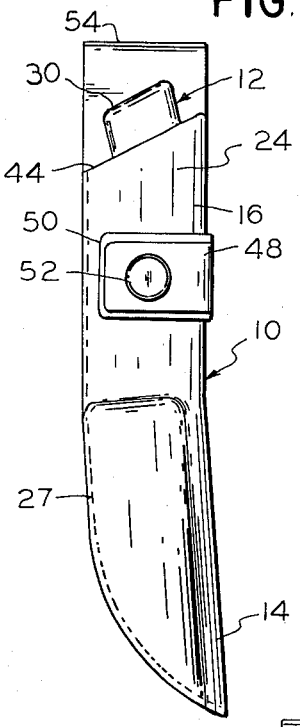
FIG. 2
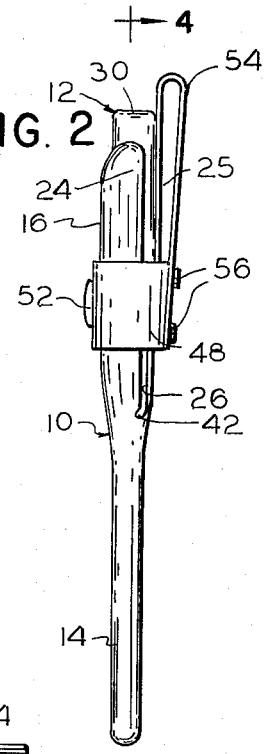
FIG. 3
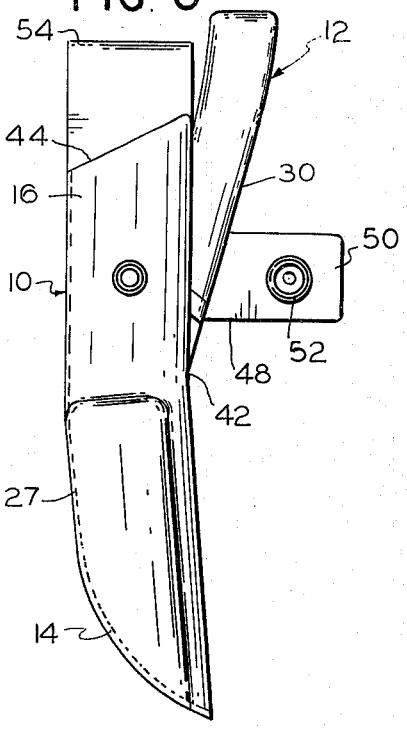
FIG. 4
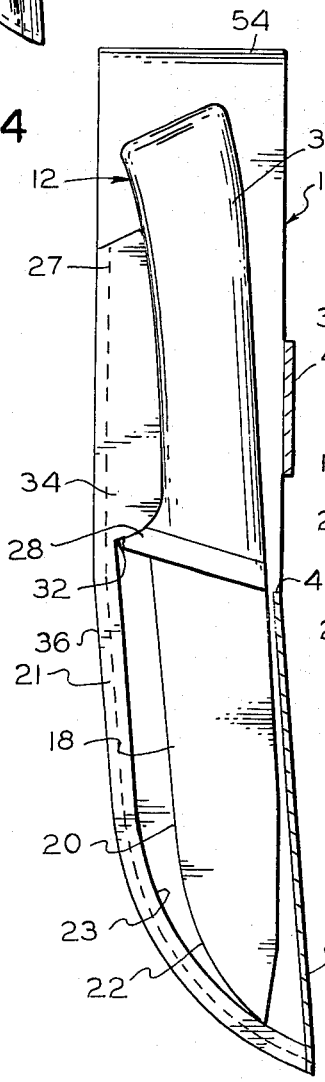
FIG. 5
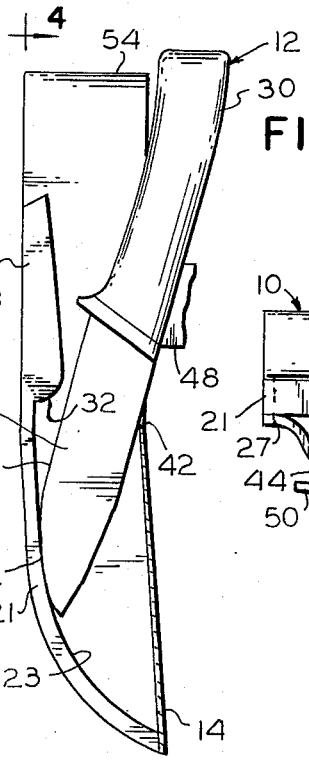
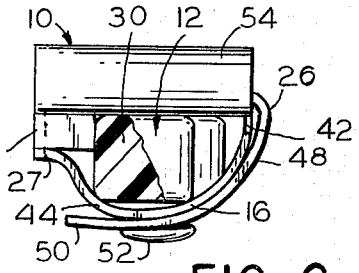
FIG. 6

KNIFE AND LOCKING SCABBARD

BACKGROUND OF THE INVENTION

This invention relates to a knife and a locking scabbard therefor.

Knives are often carried in scabbards attached to a wearer's belt. The design of some prior scabbards allows knives to be dislodged from the scabbards when the wearer is active or when the scabbard is not in an upright position. Other scabbards are designed to prevent knives from falling out or becoming dislodged, but the procedures involved in inserting knives into such scabbards and withdrawing knives from them have been cumbersome. Some scabbards designed to prevent accidental knife release have an overly complex construction and include elements which can easily become broken or loosened.

SUMMARY OF THE INVENTION

It is therefore an object of the present invention to provide a knife and scabbard which prevent accidental release of the knife from the scabbard.

It is another object of this invention to provide an interlocking knife and scabbard combination which allows insertion of the knife into the scabbard in a simple and rapid manner.

It is a further object of this invention to provide an interlocking knife and scabbard designed so that withdrawal of the knife from the scabbard may be accomplished in a simple and rapid manner.

It is a further object of this invention to provide a knife and scabbard combination wherein the knife can be simply and releasably locked within the scabbard.

It is a further object of this invention to provide a knife and scabbard combination which prevents accidental release of the knife from the scabbard without the use of complex or breakable components.

In accordance with this invention, there is provided a knife having a lateral projection thereon and a scabbard having a stop therein for engaging the projection when the knife is positioned vertically in the scabbard. The upper portion of the scabbard is flexible to allow the knife handle to be pushed laterally to disengage the projection from the stop, permitting removal of the knife from the scabbard. A flexible strap and fastener are provided to lock the knife within the scabbard and prevent its withdrawal.

Further objects, advantages and embodiments of the present invention will be apparent from the following description of the drawings and detailed description of the preferred embodiment of the invention.

BRIEF DESCRIPTION OF THE DRAWINGS

The attached drawings show a preferred embodiment of the knife and scabbard of this invention, in which:

FIG. 1 is a front elevation view of the scabbard with the knife inserted therein and the securing strap in a fastened position;

FIG. 2 is a side elevation view of the knife and scabbard shown in FIG. 1;

FIG. 3 is a front view of the knife and scabbard, wherein the strap is in an unfastened position and the knife is partially withdrawn;

FIG. 4 is a vertical section of the scabbard on line 4—4 of FIG. 2, showing the knife in side elevation;

FIG. 5 is a vertical section similar to FIG. 4 on a reduced scale, showing the knife in rotated, partially withdrawn position; and FIG. 6 is a top view of the knife and scabbard shown in FIG. 1.

DETAILED DESCRIPTION OF THE INVENTION

Referring to FIG. 1, there is shown a scabbard 10, depicted in a longitudinally vertical position as normally worn on a person's belt, with a knife 12 inserted therein. The scabbard includes a blade receiving section 14 at the lower end thereof and a resilient handle enclosing section 16 extending upwardly from the section 14.

The blade receiving section 14 is sized to surround a blade 18 of the knife 12 with a small amount of clearance between the blade edges and the inner sides of the scabbard edges to permit some lateral movement of the blade 18 (see FIGS. 4 and 5). The cutting edge 20 of the blade 18 faces a thickened welt 21 extending along one side edge of the scabbard 10 (see FIGS. 4, 5 and 6). The lower portion 22 of the blade cutting edge 20 is preferably convexly curved, and the adjacent portion of the inner edge 23 of the welt 21 is preferably concavely curved. The front side 24 and back side 25 of the scabbard 10 are preferably made from a single piece of leather folded to form the other side edge of the scabbard opposite the welt 21 below a slot opening 26 in the top portion 16 of the scabbard (see FIG. 2), the welt 21 being fixed into the seam between the front and back sides, as by sewing at 27 (see FIG. 6).

The knife has a lateral projection, such as the finger guard projection 28, extending outwardly at the bottom end of the knife handle 30 above the blade cutting edge 20 and in the plane of the blade. The upper edge of the projection 28 preferably has a slightly concave curvature. The scabbard 12 is formed to define a shoulder or stop 32 in the inner surface of one side edge thereof, which is adapted to extend over the handle projection 28 when the knife is in its vertical, fully inserted position, as shown in FIGS. 1 and 4. In the illustrated embodiment the stop 32 is formed by the welt 21, the upper portion 34 of the welt being wider than the lower portion 36, as may be seen in FIGS. 4 and 5. The upper portion of the welt is preferably contoured to match the concave upper edge of the projection 28 and the adjacent handle edge.

With the knife 12 fully inserted, the finger guard projection 28 is engaged by the stop 32, as apparent from FIG. 4, preventing upward movement of the knife. However, by pushing the knife handle toward the edge of the scabbard opposite the edge having the stop therein, the projection 28 can clear the stop to permit removal of the knife, as shown in FIG. 5. The construction permitting removal of the knife when desired will now be described.

The handle enclosing portion of the front side 24 of the scabbard is formed substantially to surround the knife handle 30, as best seen in FIGS. 2 and 6, to protect it and to prevent accidental release of the knife from the scabbard. However, this front handle enclosing portion is separated from the back side 25 by the longitudinal slot opening 26, which extends from the upper, outer longitudinal end of the scabbard downwardly to a point 42 approximately opposite the bottom of the knife handle with the knife fully inserted in the scabbard, as may be seen in FIG. 4, and preferably below the level of the stop 32 in the opposite side of the scabbard, to allow the optimum pivoting movement of the knife for disengaging the projection from the stop.

To release the knife 12, the handle 30 is pushed toward the slot 26, pivoting the knife about the bottom 42 of the slot opening. Being resilient, the scabbard portion 24 flexes enough to permit enlargement of the opening 26 to allow the knife handle to move away from the stop 32 far enough that the projection 28 will clear the stop (see FIG. 5). A small pivoting movement of the knife will cause the projection 28 to disengage from the stop 32. If the handle is pushed further through the slot, the knife is forced further outwardly from the scabbard because of the camming action occurring between the curved portion 23 of the welt 21 and the curved portion 22 of the blade 18 (see FIGS. 3 and 5), thereby permitting the handle 30 to be grasped more easily for withdrawing the knife 12 completely. Preferably the edge 44 of the upper end of the front side 24 of the scabbard slopes downward across the scabbard from the top of the opening 26 so that, with the knife fully inserted, a portion of the handle is still exposed, permitting access to the lateral surface of the handle for pushing the knife forwardly.

While the handle enclosing scabbard section 16 must be resilient enough to permit widening of the slot opening 26 when manual pressure is applied to the knife handle 30 to pivot it clockwise, as shown in FIGS. 3 and 5, the section 16 is preferably sufficiently stiff that the scabbard snugly engages the handle and retains the knife in its vertical, locked-in position unless deliberate manual pressure is applied. Once the knife 12 is inserted, it is thereafter normally secured against accidental removal, unless tangible lateral force is manually exerted on the handle to pivot the knife within the scabbard and force the handle through the slot 26, since the finger guard projection 28 normally remains engaged by the stop 32 in the welt 21.

Referring to FIGS. 2, 3 and 6, means are provided to lock the knife 12 positively within the scabbard 10. Such means comprise a strap 48 fixedly secured at one end to the back side 25 of the scabbard and adapted to be swung across the slot 26 for releasably securing its other end 50 to the front side 24 of the scabbard, as by a snap fastener 52. With the strap 48 in a fastened position across the slot 26, the knife is held locked in its fully inserted position and cannot be removed from the scabbard.

The scabbard 10 is equipped at its upper end with means, such as a flexible loop 54, for attaching the scabbard to a person's belt or the like. As shown in FIG. 2, the loop 54 is preferably a continuous extension of the back side 25 of the scabbard. One end of the strap 48 and the end of the loop 54 may both be fixed to the back side 25 of the scabbard by the same attaching means, such as rivets 56.

Because the scabbard section 16 is sufficiently stiff that manual force is needed to widen the slot opening 26 to allow pivoting movement of the handle 30, the knife and scabbard can be worn by an active person with the strap 48 in the unfastened position, as shown in FIGS. 3 and 5. There is no danger of the knife 12 jumping upwardly out of the scabbard 10, because the projection 28 and the stop 32 are in continuing engagement. On the other hand, with the strap 48 unfastened, the knife can be withdrawn quickly and easily at any time by pushing the knife handle 30 forwardly through the slot 26, and then simply withdrawing the knife upwardly from the scabbard, as described previously.

The procedure required in many locking scabbards of unfastening a latch mechanism each time the knife is to be removed is thus eliminated.

To insert the knife 12 into the scabbard 10, it is simply pushed downwardly in the scabbard. The upper scabbard section 16 is sufficiently resilient to flex, permitting the knife to be pushed in until the projection 28 clears the shoulder or stop 32, whereupon the knife is forced to an upright, locked-in position by the scabbard and retained in such position until deliberate manual action is taken to release it.

A preferred embodiment of the knife and locking scabbard of this invention having been described, variations, modifications and equivalents of the preferred embodiment of the present invention will be apparent to those skilled in the art.

I claim:

1. An interlocking knife and scabbard device which comprises in combination:

a knife having a generally planar blade and a handle, said knife having a projection extending laterally therefrom in the plane of said blade;

a scabbard including a blade receiving section and a handle enclosing section extending longitudinally from said blade receiving section;

said scabbard defining a stop along an inner side of one edge thereof for engaging over said projection when said knife is inserted in said scabbard to prevent longitudinal withdrawal movement of said knife with respect to said scabbard;

said handle enclosing section being resilient to permit movement of said knife handle toward an edge of said scabbard opposite said one edge, thereby disengaging said projection from said stop and permitting withdrawal of said knife from said scabbard.

2. The combination of claim 1 wherein said handle enclosing section has a longitudinal slot opening extending from the upper end thereof along said edge opposite said one edge thereof, said opening having a width normally less than the width of said handle.

3. The combination of claim 2 wherein said scabbard includes means for releasably preventing flexing of said handle enclosing section with said knife in said scabbard to lock said knife releasably in said scabbard.

4. The combination of claim 3 wherein said means for releasably preventing flexing of said handle enclosing section includes a strap having one end thereof fixed to said handle enclosing section; and a releasable fastening means operatively connected between the other end of said strap and said handle enclosing section for releasably fastening said strap other end to said handle enclosing section in a fastened position;

said strap being fixed across said slot opening to prevent widening thereof when said strap is in said fastened position.

5. The combination of claim 1 further including means on said scabbard for attaching said scabbard to the belt of a person.

6. The combination of claim 1 wherein said projection comprises a finger guard projection adjacent a cutting edge of said blade.

7. The combination of claim 1 wherein the upper edge of one side of said handle enclosing section slopes downwardly across the scabbard from the top of said opening so that a portion of the lateral surface of said knife handle is exposed with said knife fully inserted in said scabbard.

8. The combination of claim 2 wherein a portion of said one inner edge below said stop in said blade receiving section is concavely curved and a portion of said knife blade below said projection is convexly curved and the bottom edge of said slot opening is spaced beneath said stop, so that lateral movement of said knife handle forces said knife outwardly from said scabbard by camming movement of said blade curved portion against said inner edge curved portion as said knife pivots about the bottom edge of said slot opening.

9. A scabbard for holding a knife which has a lateral projection on one side thereof and has a generally planar blade with a convexly curved edge below said projection on said one side, which comprises:

a blade receiving section; and a handle enclosing section;

one edge of said scabbard defining a stop in the inner side thereof for engaging with said projection to prevent withdrawal of said knife;

said handle enclosing section being adapted for snugly enclosing the handle of said knife when said knife is within said scabbard to prevent disengagement of said projection from said stop;

said handle enclosing section being resilient to permit insertion of said knife into said scabbard and to permit lateral movement of said knife handle in the plane of said blade responsive to manual force thereon for disengaging said projection from said stop to allow withdrawal of said knife;

said inner side of said one scabbard edge having a concavely curved portion below said stop in said blade receiving section so that said knife is forced outwardly from said scabbard by camming movement of said knife blade curved portion against said curved edge portion of said scabbard when said knife handle is moved laterally.

10. A scabbard as defined in claim 9 wherein said handle enclosing section has a longitudinal slot opening extending from the upper end thereof along a portion of an edge opposite said one edge.

11. In combination a knife and a scabbard;

said knife having a generally planar blade formed with a convexly curved cutting edge and a handle provided with a finger guard projecting from said handle beyond said edge, said finger guard being concavely curved;

said scabbard comprising a folded piece of leather defining a blade receiving section having a welt positioned between the folded edges of said piece;

said welt being concavely curved along its lower portion complementally to the curved edge of said knife blade;

said welt being formed with a convexly curved projection shaped to conform to the concave shape of said finger guard and extending over said finger guard in the normal sheathed position of said knife;

said scabbard further comprising a handle enclosing section extending longitudinally upwardly from said blade receiving station and at least partially enclosing said knife handle and retaining said knife in said normal sheathed position;

said handle enclosing section having a slot along the edge thereof opposite said welt extending downwardly to a point slightly below said projection and being flexible whereby said knife handle may be pushed at least partially through said slot to clear said finger guard from said welt projection thus to permit withdrawal of said knife from said sheath;

the curvature of said blade and welt causing said knife to be moved upwardly in said scabbard as said handle is forced through said slot.

* * * * *